US012296935B2

(12) United States Patent
Neathery et al.

(10) Patent No.: US 12,296,935 B2
(45) Date of Patent: May 13, 2025

(54) MARINE CONTROL STATION

(71) Applicant: Caterpillar Inc., Peoria, IL (US)

(72) Inventors: Brian P. Neathery, Hockley, TX (US); Cameron S. Gandy, Houston, TX (US); Merritt P. Callaghan, Cypress, TX (US)

(73) Assignee: Caterpillar Inc., Peoria, IL (US)

( * ) Notice: Subject to any disclaimer, the term of this patent is extended or adjusted under 35 U.S.C. 154(b) by 1008 days.

(21) Appl. No.: 17/334,287

(22) Filed: May 28, 2021

(65) Prior Publication Data

US 2022/0380013 A1 Dec. 1, 2022

(51) Int. Cl.
*B63H 21/21* (2006.01)

(52) U.S. Cl.
CPC ..... *B63H 21/213* (2013.01)

(58) Field of Classification Search
CPC ..... B63H 21/213
See application file for complete search history.

(56) References Cited

U.S. PATENT DOCUMENTS 4,020,713 A * 5/1977 Cantley ..... G05G 9/08 74/480 B
5,214,977 A * 6/1993 Nagafusa ..... B63H 21/22 74/480 B
5,280,282 A * 1/1994 Nagafusa ..... B63H 21/213 440/86
5,481,261 A * 1/1996 Kanno ..... B63H 20/08 114/144 R
5,741,166 A * 4/1998 Newman ..... G05G 11/00 440/84
6,273,771 B1 * 8/2001 Buckley ..... G08G 3/02 114/144 RE
6,485,340 B1 11/2002 Kolb et al.
7,108,570 B2 9/2006 Okuyama
8,038,489 B2 * 10/2011 Suzuki ..... F16H 61/16 440/86
2003/0092331 A1 * 5/2003 Okuyama ..... B63H 21/22 440/84
2017/0158303 A1 * 6/2017 Michaelis ..... G06V 10/75
2017/0300054 A1 * 10/2017 Hanson ..... B63B 1/32
2022/0380013 A1 * 12/2022 Neathery ..... B63H 21/213

FOREIGN PATENT DOCUMENTS

KR 20160071953 A 6/2016
WO WO-2013034935 A1 * 3/2013 ..... B63B 3/08
WO WO-2017004419 A1 * 1/2017 ..... B60F 5/00

OTHER PUBLICATIONS

Written Opinion and International Search Report for Int'l. Patent Appln. No. PCT/US2022/030201, mailed Oct. 18, 2022 (13 pgs).

* cited by examiner

*Primary Examiner* — S. Joseph Morano
*Assistant Examiner* — Jovon E Hayes

(57) ABSTRACT

An advanced control station system for a marine vessel. The control station provides a motor-controlled lever head with the ability to control the amount of pressure required to move the lever head as well as the ability to set adjustable detents within the range of motion of the lever head. The advanced control station further provides for electronic communication between multiple stations controls so that the throttle and transmission settings from one control station can be synchronized during a control station transfer.

2 Claims, 7 Drawing Sheets

MARINE CONTROL STATION

TECHNICAL FIELD

The invention relates to a marine control station for controlling the engine and transmission functions of a marine vessel. More specifically, the invention relates to a marine control station system that is connected and controlled by a computer such that the computer senses the transmission and throttle position at an active control station and automatically synchronizes a target control station with an active control station.

BACKGROUND

Marine vessels generally include control stations for steering control and for controlling the propulsion of the marine vessel, whether it is an inboard motor or an outboard motor having a propulsion mechanism, such as a jet, a propeller or another thrust generating device. Larger vessels typically include more than one control station. In the past, marine control stations included mechanically or hydraulically linked devices. More recent control mechanisms employ one or more electronic systems. For example, the electronic systems may include an inboard local area network (LAN) that electrically connects a control station or more than one control station to the motor controls of a vessel. The inboard LAN may also connect other devices to one or more communication cables between the control station and the motor controls for a vessel.

Known electronic control systems for marine vessels include a number of drawbacks when, for example, the marine vessel includes multiple control stations. For example, when it is desired to switch between control stations, currently, the operator is required to synchronize the levers of the two control stations to perform a station transfer. Typically, this is a manual process that requires that operations communicate via radio to physically align the levers at the target control station to the levers of the active control station. Prior control stations also suffer from either a lack of resistance or too much resistance to movement of the throttle control, making delicate throttle adjustments difficult. Additionally, prior control stations suffer from a lack of intermediate settings such as for efficient cruising speeds.

U.S. Pat. No. 5,741,166 discloses an electrically controlled hydraulic system for operating multiple remote helms of a marine vessel. The remote helms include switches that, when closed, energize solenoids to control engine throttle, transmission and steering. When activated to an open position, the solenoid valves supply hydraulic fluid pressure that moves the pistons in engine throttle control cylinder and transmission shift control cylinder on each engine, thereby moving the corresponding engine throttle and transmission shift control levers.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In accordance with one aspect of the disclosure, an advanced control station for providing engine and transmission control for a marine vessel is disclosed having an input lever for actuating the engine and transmission of the marine vessel, the input lever comprising a base and being rotatably mounted about the base; a motor connected to the base of the input lever so as be operable to control the rotation of the input lever, and a propulsion control processor in electronic communication with the motor, the propulsion control processor being operable to communicate with the motor to rotate the input lever to an engine and transmission control setting specified by the propulsion control processor.

In accordance with a second aspect of the disclosure, an advanced control system for the engine and transmission of a marine vessel is disclosed comprising an active control station for controlling the engine and transmission of a marine vessel, a second control station comprising an input lever for controlling the engine and transmission of a marine vessel and a motor connected to the base of the input lever and operable to control the rotation of the input lever; and a propulsion control processor in electronic communication with the active control station and with the motor second control station motor, the propulsion control processor being operable to communicate an engine and transmission control setting from the active control station to the second control station to direct the motor to move the input lever of the second control station to match the engine and transmission setting of the operating control station.

In accordance with a third aspect of the disclosure, an advanced control system for the engine and transmission of a marine vessel is disclosed having a first control station for controlling the transmission and throttle of a marine vessel, the first control station comprising a display screen in electronic communication with the propulsion control processor, a second control station comprising: an input lever for actuating the transmission and throttle of the marine vessel, the input lever comprising a base and being rotatably mounted about the base, a motor connected to the base of the input lever so as be operable to control the rotation of the input lever; and a display screen in electronic communication with the propulsion control processor, a propulsion control processor in electronic communication with the motors, the propulsion control processor being operable to communicate an engine and transmission control setting from the first control station to the second control station to actuate the motor to move the input lever of the second control station to a throttle and transmission setting that matches the first control station.

DETAILED DESCRIPTION

Figure 1:
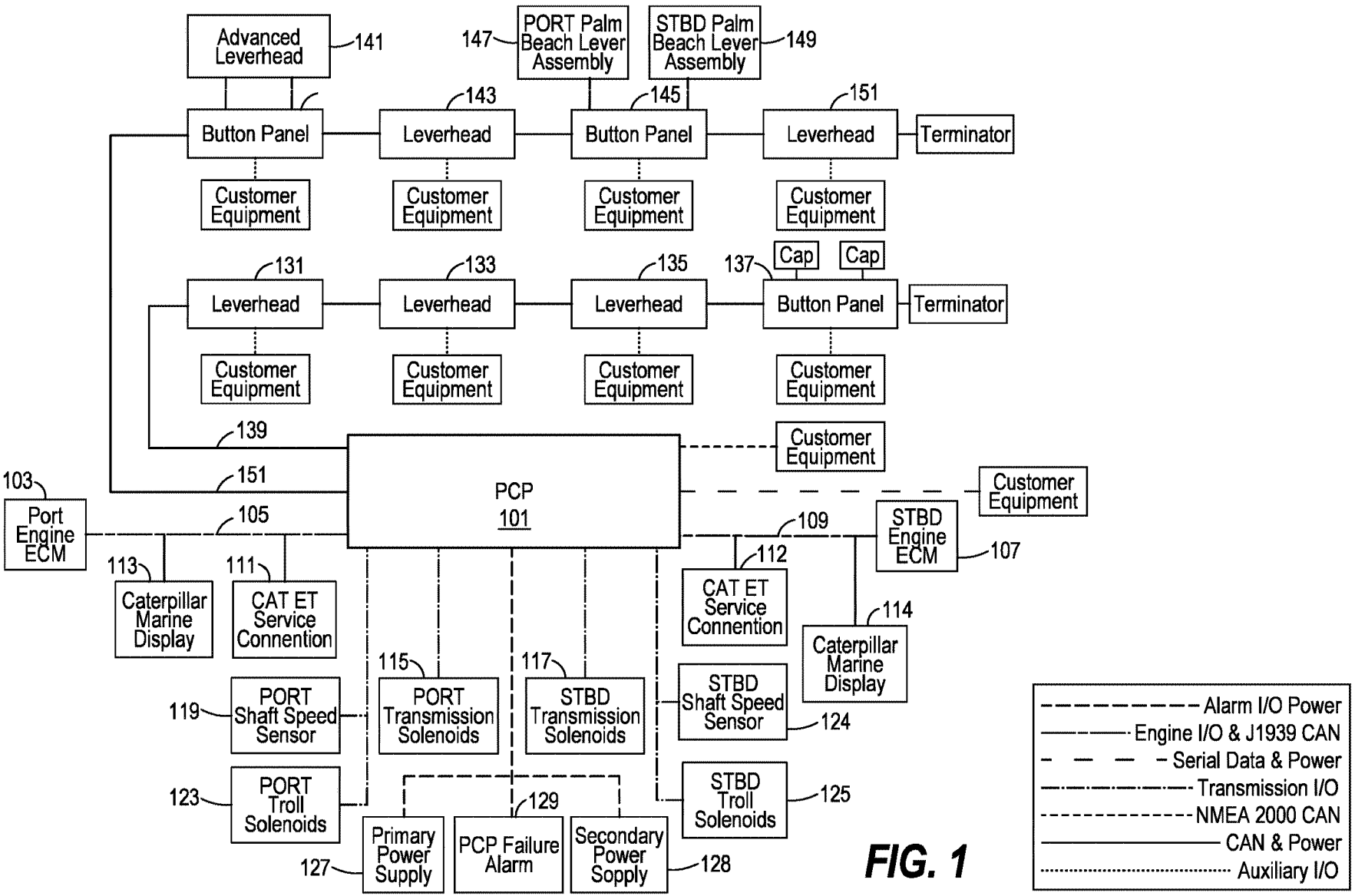
FIG. 1 shows a single line diagram a marine propulsion control system comprising a propulsion control processor and up to eight (8) control stations

Now referring to the drawings in detail, wherein like reference numerals refer to like elements throughout, FIG. 1 is a single-line diagram showing an overview of a marine propulsion control system 101. The marine propulsion control system 101 is directed to fixed pitch propeller marine applications and is capable of operation with single engine single-shaft or dual engine dual-shaft configurations.

Figure 2:
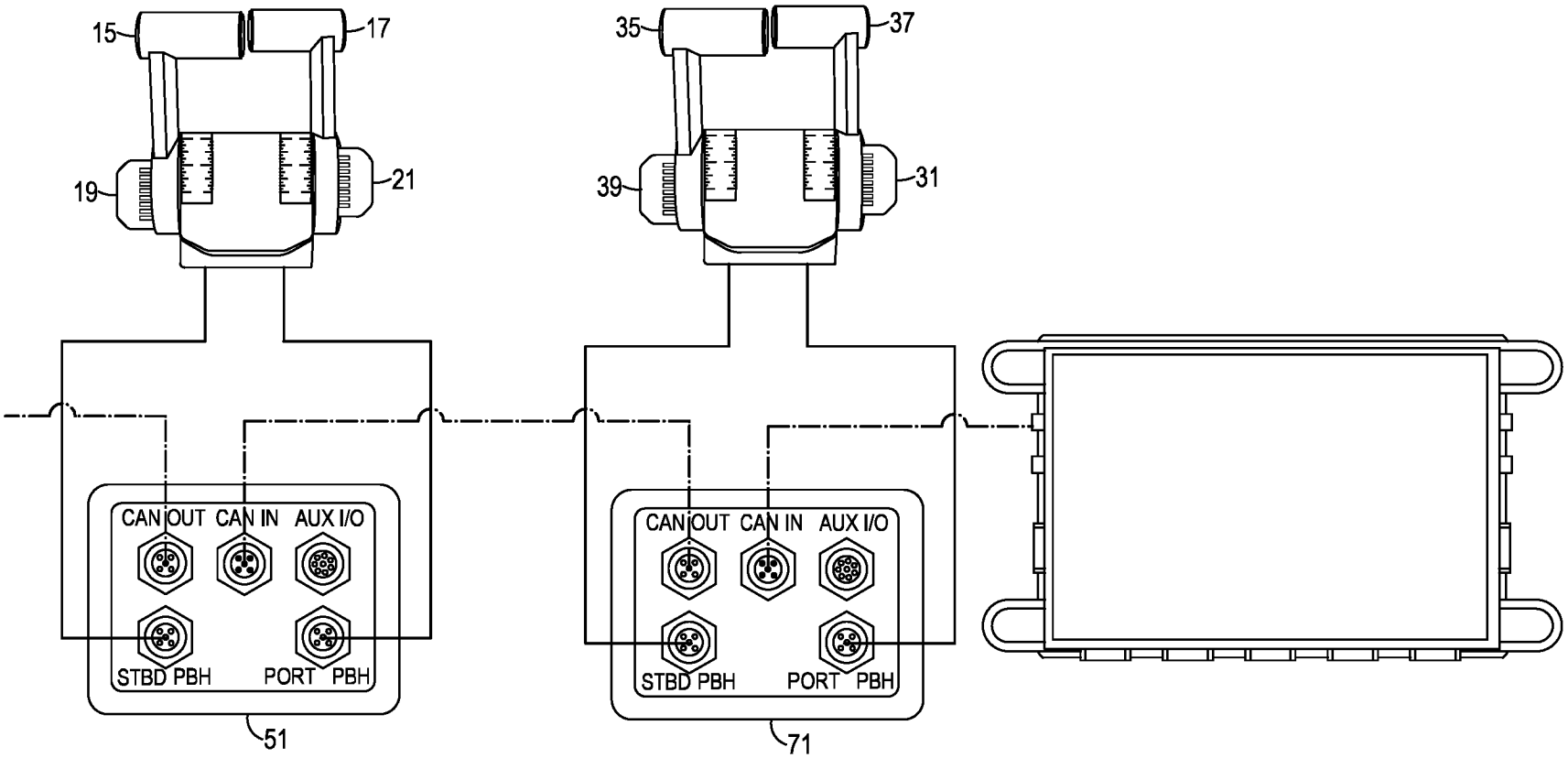
FIG. 2 shows an advanced lever head and the associated connections between the advanced lever head and the propulsion control processor.

Referring to FIG. 2, which depicts an active control station 11 and a target control station 31. Each of the active control station 11 and the target control station comprises a support housing 13, 33 a port lever 15, 35 and a starboard lever 17, 37. Support housing 13, 33 of active control station 11 encloses a motor 19 operable to actuate the port transmission/throttle control lever 15 and a motor 21 operable to actuate the starboard transmission/throttle control lever 17 independently to a desired or programmed position. Likewise, support housing 33 of target control station encloses a motor 39 operable to actuate the port transmission/throttle control lever 35 and a motor 41 to actuate the starboard transmission/throttle control lever 37. Both the active control station 11 and the target control station 31 are connected electronically to propulsion control module 101 via button panels 51, 71.

Still referring to FIG. 2, active button panel 51 is in communication with active control station 11 and target button panel 71 is in electronic communication with target control station 71 via serial communication using a proprietary serial protocol between the button panels 51, 71 and the control stations 11, 31. The communications occur via universal asynchronous receiver/transmitter circuits. The datalinks should preferably support baud rates of up to 115.2 kilobits per second. As shown in FIG. 2, the active button panel 51 is electronically connected to the motor 19 operable to actuate the port transmission/throttle control lever and the motor 21 operable to actuate the starboard transmission/throttle control lever 17. Likewise, the target button panel 71 is electronically connected to the motor 39 operable to actuate the port transmission/throttle control lever 35 and the motor 41 operable to actuate the starboard transmission/throttle control lever 37. Advanced control station 11 provides throttle and transmission control via a single mechanical lever 15 for a port engine and a single mechanical lever 17 for a starboard engine. Single engine configurations for the control station are also available.

Figure 3:
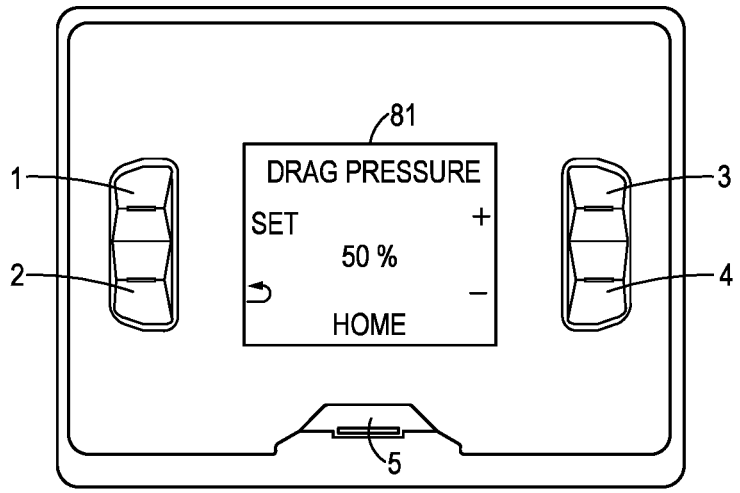
FIG. 3 shows a screenshot of the control screen for the drag pressure adjustment for the advanced lever head.

Advanced control station 11 allows an operator to set a preferred relative amount of pressure required to move a transmission/throttle control lever 15 by adjusting the level of resistance to movement offered by the motor 19 attached to the transmission/throttle control lever 15. Adjusting the relative amount of pressure makes it more or less difficult to move the transmission/throttle control lever 15. Referring now to FIG. 3, which shows the operator facing side of the button panels shown in FIG. 2, pressing button 1 on the button panel permits an operator to access the drag pressure setting screen 81. Drag pressure can then be adjusted to a selected relative amount. Pressing button 3 on the drag pressure screen 81 increases the drag pressure in 1% increments. Pressing button 4 on the drag pressure screen decreases the drag pressure in 1% increments. Holding button 3 for more than one (1) second will begin continuous incremental increases of the drag pressure setting by 1% until button 3 is released. Likewise, holding button 4 for more than one (1) second will begin continuous incremental decreases of the drag pressure setting by 1% until button 4 is released. Pressing button 5 navigates to the home screen.

Figure 4:
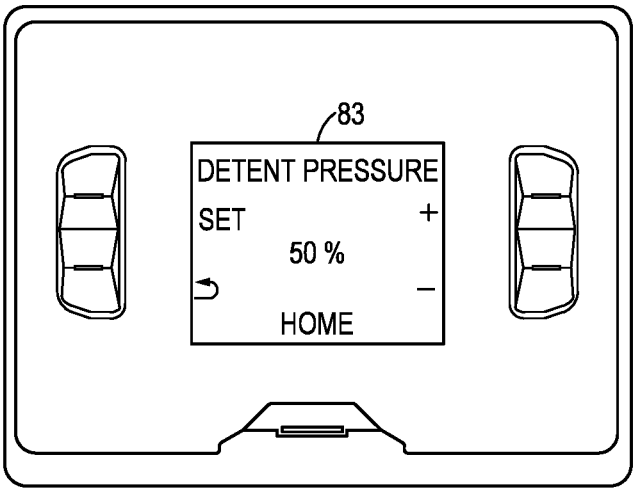
FIG. 4 shows a screenshot of the control screen for the detent pressure adjustment for the advanced lever head.

Referring now to FIG. 4, which shows the detent pressure screen 83 of the advanced lever head 11. The detent pressure screen 83 allows the user to adjust the amount of pressure required to overcome a detent within the range of motion of the transmission/throttle control lever 15 by adjusting the level of resistance offered by the motor 19 attached to the transmission/throttle control lever 15. With respect to a specific detent, pressing button 3 increases the relative detent pressure by 1%. Pressing and holding button 3 increases the relative detent pressure in increments until the button is released. Pressing button 4 decreases the relative detent pressure by 1%. Pressing and holding button 4 decreases the relative detent pressure in increments until the button is released. Pressing button 5 navigates to the home screen.

Figure 5:
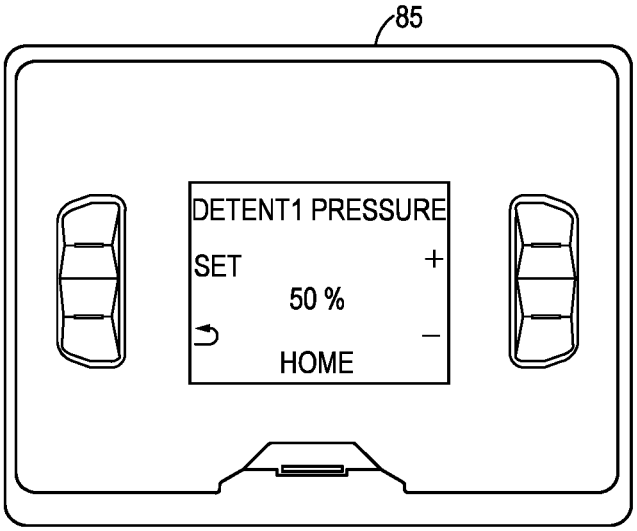
FIG. 5 shows a screenshot of the control screen for setting additional detent pressure settings.

Referring now to FIG. 5, which shows show the Detent 1 Pressure screen 85. Advanced control station 11 can provide any number of preset detents, but for purposes of this example, includes ten (10) detents, each of which can be set individually. As with the above examples, pressing button 3 increases the detent pressure and button 4 decreases the relative detent pressure. Pressing and holding button 3 or button 4 alternately increases or decreases the relative detent pressure.

Figure 6:
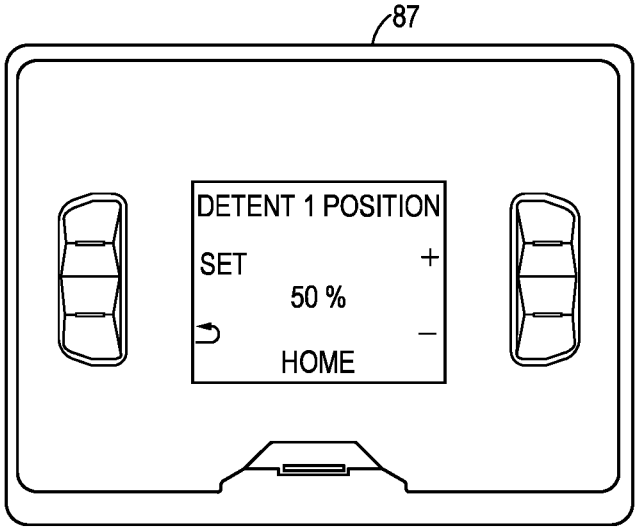
FIG. 6 shows a screenshot of the control screen for setting the position of a detent where more than one detent is used.

Referring now to FIG. 6, which shows the Detent 1 Position screen 87. Pressing Button 3 increases the detent position along the range of travel of transmission/throttle control lever 15 by 1%, while pressing button 4 decreases the detent position along the range of travel by 1%. Pressing and holding button 3 or button 4 incrementally increases or decreases the detent position continuously until the button is released. Default detent positions can be set at various positions, but in one example are set increments of 10%. Such detent positions can be useful for pre-setting optimum cruising speeds.

Figure 7:
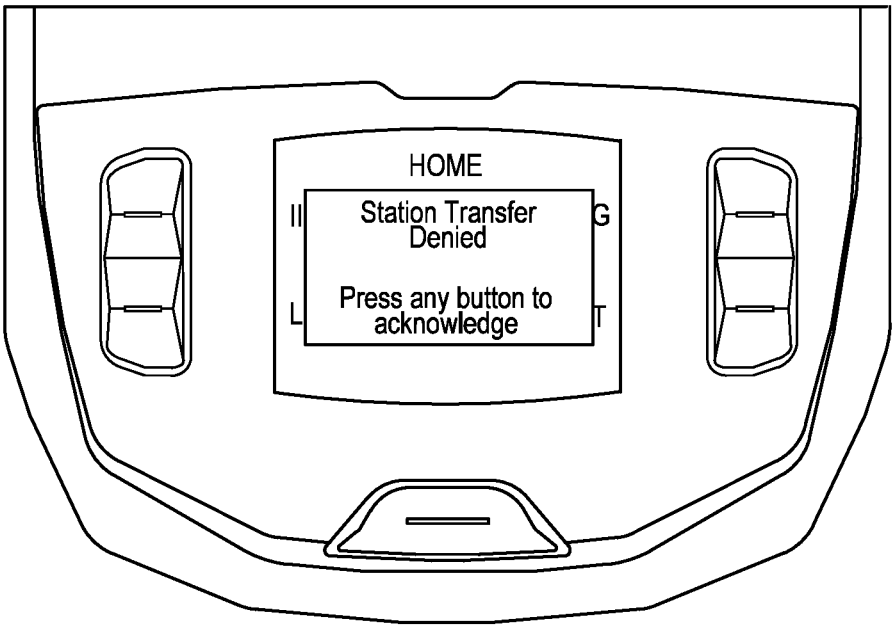
FIG. 7 shows a screenshot of the control screen during the control station transfer process showing a Station Transfer Denied message.
Figure 8:
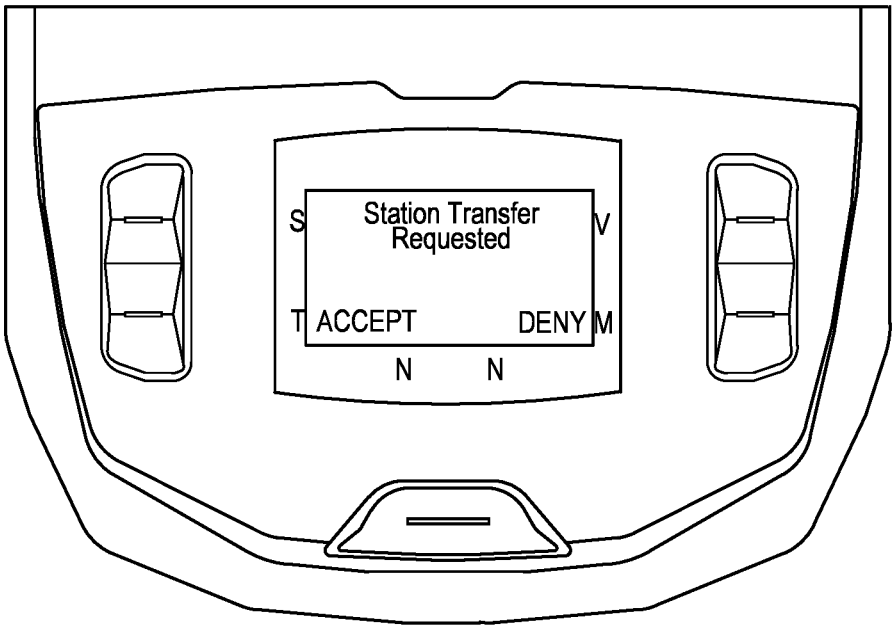
FIG. 8 shows a screenshot of the control screen during the control station transfer process showing a Station Transfer Requested message.
Figure 9:
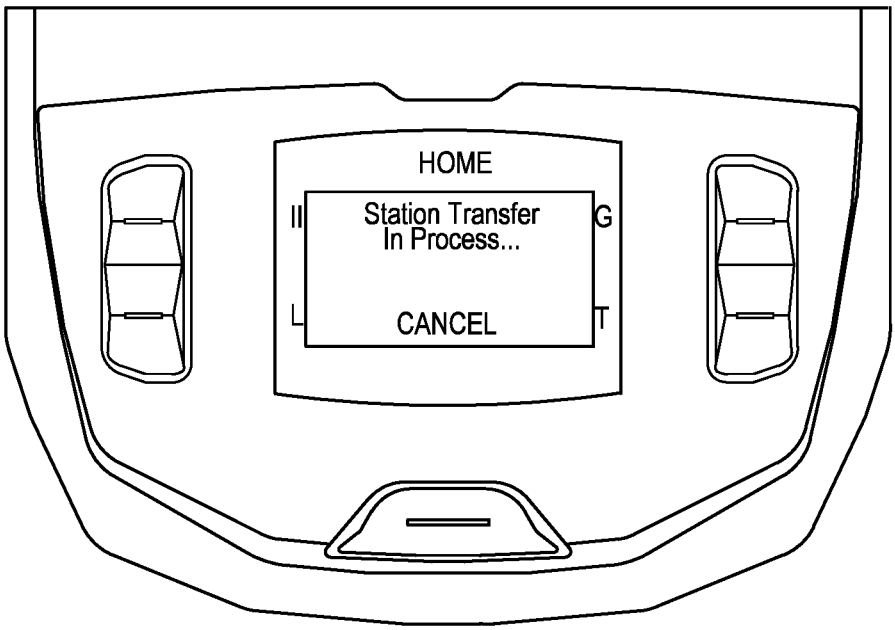
FIG. 9 shows a screenshot of the control screen during the control station transfer process showing a Station Transfer In Process message.
Figure 10:
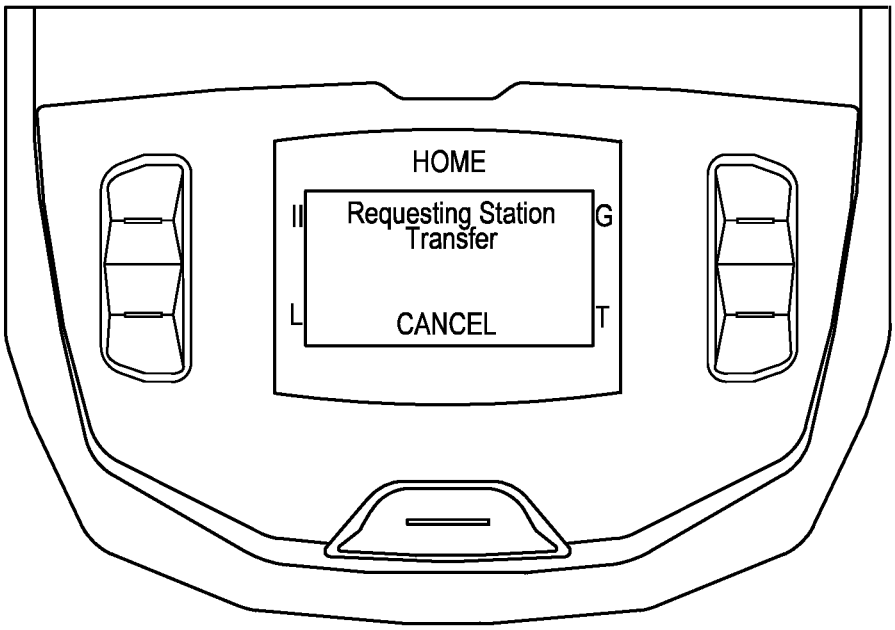
FIG. 10 shows a screenshot of the control screen during the control station transfer process showing a Requesting Station Transfer message.
Figure 11:
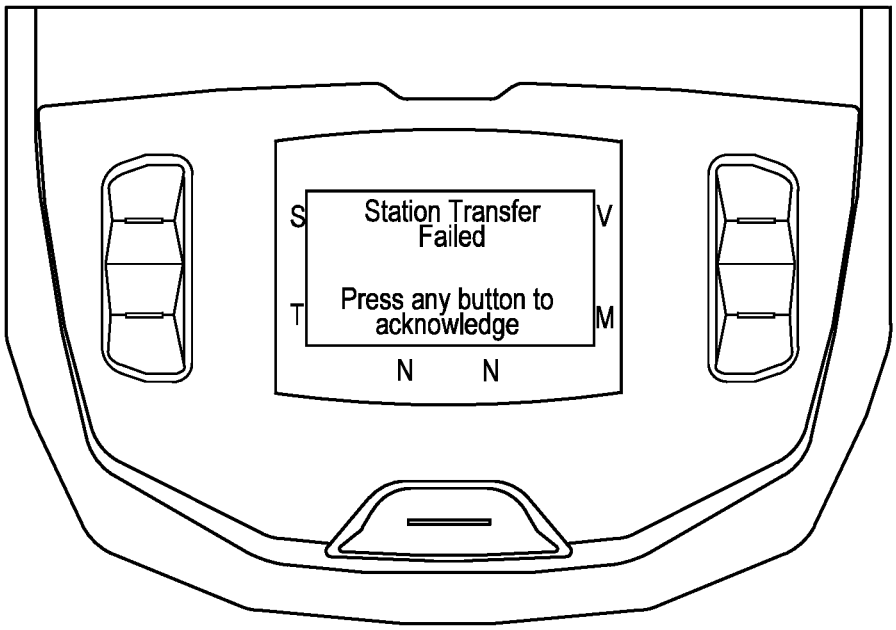
FIG. 11 shows a screenshot of the control screen during the control station transfer process showing a Station Transfer Failed message.
Figure 12:
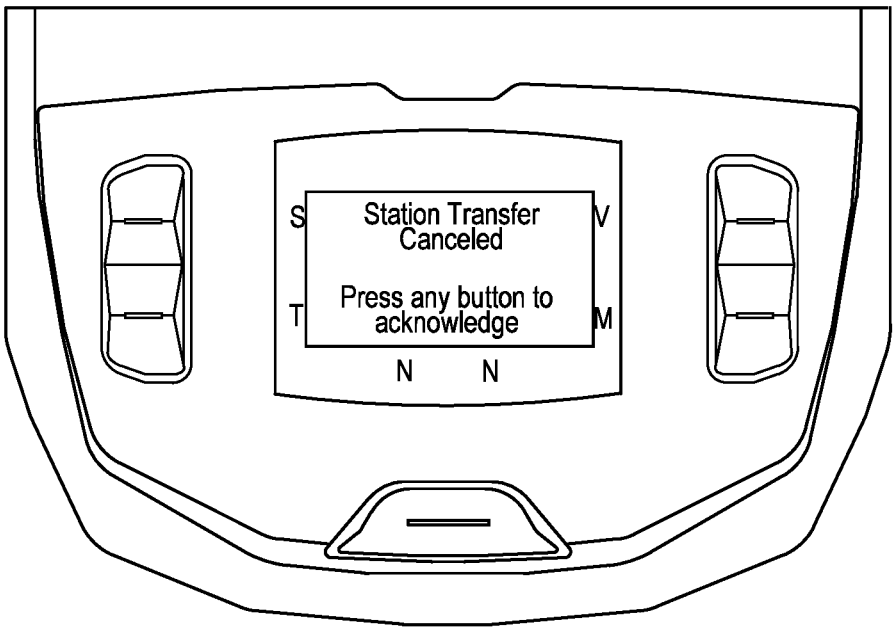
FIG. 12 shows a screenshot of the control screen during the control station transfer process showing a Station Transfer Cancelled message.

The advanced lever head 11 further allows for automatically synchronizing the position of the transmission/throttle control lever 35 of a target control station 31 with the transmission/throttle control lever 15 an active control station 11 during a transfer of station command. Specifically, when it is desired to control a vessel from a different control station, the operator of the target control station 31 can request permission from the active control station 11 to transfer control to the target control station 31 as show in FIGS. 7-12. More specifically, as shown in FIG. 10 an operator using a target control station 31 could actuate button 5 on button panel to request control from the active control station 11. Upon receipt of that request; as shown in FIG. 8, active control station 11 would generate a popup message indicating that a station transfer request was received from a target control station 31. At that point, the operator of the action control station would have the option to accept the transfer by pressing button 2 on the active control station 11 or button 4 or button 5 on the active control station 11 to deny the transfer. Accepting the transfer would result in a message stating "transfer in progress" as shown in FIG. 9 on both the active control station 11 and the target control station 31. Denying the transfer request results in a return to the active station screen for the active control station 11. Additionally, as shown in FIG. 7, denying the transfer would result in a message Station Transfer Denied being displayed on the target control station 31. If control station transfer is accepted, both the active control station 11 and the target control station 31 control display a message advising that station transfer is in progress as shown in FIG. 9. Additionally, the transmission and throttle transmission positions are transmitted from the active control station 11 to the target control station 31, resulting in the target station's transmission/throttle control lever 35 being moved so as to be synchronized with the transmission/throttle control levers of the active control station 11 ("qualified"). If for any reason the transmission/throttle control lever 35 of the target control station 31 are not qualified within a preset window of time, both the target control station 31 and the active control station 11 show a message indicating that the transfer failed as shown in FIG. 11. It must be noted that the use of the term "button" is meant to include all means of actuating an electronic signal, including, for example, touchpads, and not be limited to the use of a physical button.

While the foregoing explanation has focused on a single-engine marine vessel having a single engine active control station 11 and a single engine target control station 31, the same process can be followed to transfer control of a multiengine marine vessel. As shown in more detail in FIG. 1, which shows a single line diagram overview of a marine propulsion control system, the marine propulsion control system can include up to eight (8) control stations for a multiengine marine vessel. In the particular embodiment shown, the propulsion control processor 101 is in communication with a port engine electronic control module 103 via port engine harness and 105 and a starboard engine control module 107 via starboard engine control harness 109. Engine harnesses 107 and 109 may further include port and starboard service connections 111, 112 and display connections 113, 114. Propulsion control module 101 further includes electronic transmission controls via the port transmission solenoid 115 and starboard transmission solenoid 117 as well as a port shaft speed sensor 119 and a starboard shaft speed sensor 129. Port trolling solenoid 123 and starboard trolling solenoid 125 are also controllable via propulsion control module 101. Propulsion control module 101 further includes a primary power supply 125 and a secondary power supply 128 as well as a power failure alarm 129.

Still referring to FIG. 1, propulsion control module 101 is in electronic communication with up to three control stations (lever heads) 131, 133, 135 via a single data link 139. As shown, control station 135 is configured as a backup control station and includes a button panel 137. Second data link 151 is in electronic communication with two lever head control stations 143, 151 and a button panel 139 and advanced control station 141 as well as a button panel 145 and Palm Beach lever assembly 147, 149.

In FIG. 1, advanced lever head control station 141 can be configured according to foregoing process such that the transmission/throttle controls 15, 17 for the port and starboard engines are synchronized during the station transfer process from an active control station 11 to a target control station 31, such as the advanced lever head control station 141 shown in FIG. 1.

INDUSTRIAL APPLICABILITY

The teachings of the present disclosure can find applicability in many situations wherein engine or transmission control for a vehicle is required at multiple locations. For example, marine vessels could greatly benefit from the control system disclosed herein by providing multiple control stations for a single vessel. While marine applications are disclosed in the greatest detail herein, it is to be understood the present teachings could be also be employed in construction, earth-moving and agricultural vehicles as well where multiple control stations could be used.

While the foregoing structure may be employed in numerous area, one embodiment is in connection with marine vessels, where it may comprise a method for transferring control between control stations of a marine vessel comprising the steps of: providing an active control station comprising a throttle and transmission control; providing a target control station comprising an input lever for controlling the engine and transmission of a marine vessel and a motor connected to the base of the input lever and operable to control the rotation of the input lever; providing a propulsion control processor in electronic communication with the active control station and with the motor in the target control station, the propulsion control processor being operable to communicate an engine and transmission control setting from the active control station to the target control station to direct the motor to move the input lever of the second control station to match the engine and transmission setting of the operating control station. The method may further include the step of adjusting the relative amount of pressure required to move the input lever. The method may also include the step of setting at least one detent between an upper limit of travel and a lower limit of travel of the lever. A further embodiment of the method may also include the step of providing electronic communication between the active control station and the target control station such that the target control station can initiate a transfer of control.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. An advanced control system for the engine and transmission of a marine vessel comprising:

an active control station for controlling the engine and transmission of a marine vessel;

a second control station comprising an input lever for controlling the engine and transmission of a marine vessel and a motor connected to the base of the input lever and operable to control the rotation of the input lever; and a propulsion control processor in electronic communication with the active control station and with the motor second control station motor, the propulsion control processor being operable to communicate an engine and transmission control setting from the active control station to the second control station to direct the motor to move the input lever of the second control station to match the engine and transmission setting of the operating control station wherein the second control station is operable to electronically communicate with the active control station via the propulsion control processor to transfer control from the active control station to the second control station and to actuate the motor in the second control station to move the input lever of the second control station to match the throttle/transmission control of the active control station.

2. An advanced control system for the engine and transmission of a marine vessel comprising:

an active control station for controlling the engine and transmission of a marine vessel;

a second control station comprising an input lever for controlling the engine and transmission of a marine vessel and a motor connected to the base of the input lever and operable to control the rotation of the input lever; and a propulsion control processor in electronic communication with the active control station and with the motor second control station motor, the propulsion control processor being operable to communicate an engine and transmission control setting from the active control station to the second control station to direct the motor to move the input lever of the second control station to match the engine and transmission setting of the operating control station wherein the second control station further comprises a button that, when actuated, is operable to electronically communicate with the propulsion control processor to initiate a change in control from the active control station to the second control station.

* * * * *